US005209490A

United States Patent [19]

Dallavecchia

[11] Patent Number: 5,209,490

[45] Date of Patent: May 11, 1993

[54] MULTI-PURPOSE TOY

[75] Inventor: Raymo Dallavecchia, Bloomfield Hills, Mich.

[73] Assignee: Poof Toy Products, Inc., Plymouth, Mich.

[21] Appl. No.: 850,889

[22] Filed: Mar. 13, 1992

[51] Int. Cl.[5] ..... A63B 67/00; A63H 27/00

[52] U.S. Cl. ..... 273/346; 446/46

[58] Field of Search ..... 446/46, 47, DIG. 901; 273/DIG. 30, 346, 347, 67 B, 424

[56] References Cited

U.S. PATENT DOCUMENTS

| | | | |
|---|---|---|---|
| 4,017,076 | 4/1977 | Bai | 273/346 |
| 4,516,774 | 5/1985 | Nankivell | 273/67 B |
| 4,789,161 | 12/1988 | Waskelo | 273/DIG. 30 X |
| 4,995,617 | 2/1991 | Lee | 273/346 |
| 5,082,291 | 1/1992 | Appel et al. | 273/DIG. 30 X |

*Primary Examiner*—Mickey Yu

*Attorney, Agent, or Firm*—Krass & Young

[57] ABSTRACT

A multi-purpose toy to be used in the game of catch. A plate doubles as both a throwing implement and a catching implement. Placement of an easily removable plate cover converts the plate into a catching implement; removal of the plate cover enables the plate to be a throwing implement.

7 Claims, 2 Drawing Sheets

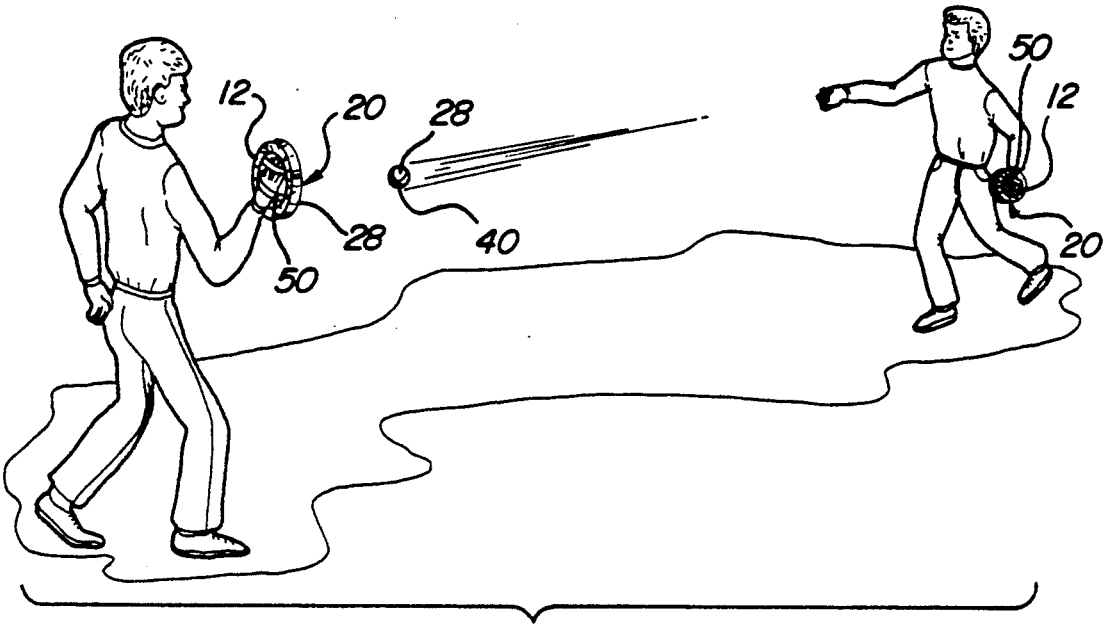
FIG-4
FIG-5
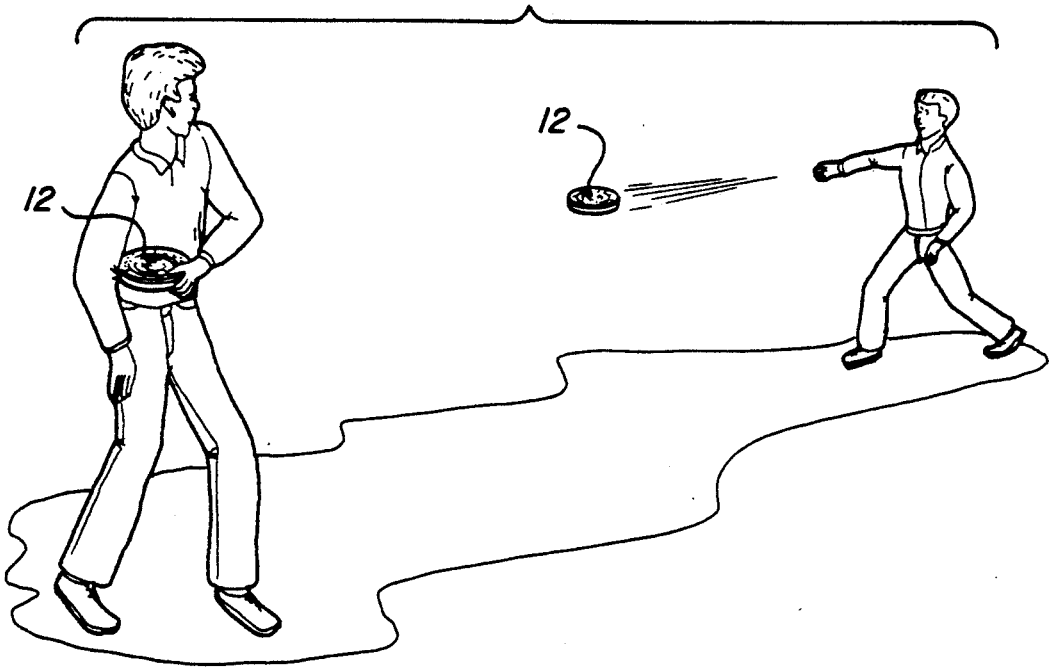

MULTI-PURPOSE TOY

BACKGROUND OF THE INVENTION

1. Field of the Invention

This invention relates generally to the field of toys and games and more particularly concerns a multi-purpose toy including a substantially planar aerodynamic plate which may be used either as a catching implement or a throwing implement in the game of catch.

2. Description of the Relevant Prior Art

The prior art discloses catching implements which improve a player's ability to catch a ball by applying a fastening material to the ball which readily attaches to a corresponding fastening material on the catching implement. For example, U.S. Pat. No. 4,017,076 of Bai discloses a hemispherical catching glove having a sheet of fabric fastening material adhesively attached to the catching face of the glove. Strips of complementary fastening material are attached to a ball and the strips interact upon contact with the fastening material on the glove to enable the player to catch the ball easily. U.S. Pat. No. 4,995,617 of Lee discloses a similar ball and catching implement which use fastening materials designed to interact with one another to facilitate the catching of the ball. In Lee, a retaining ring is used to hold the fastening material in place on the catching implement so that when the ball is removed after being caught, the fabric on the catching implement is not also removed. Both the Bai and Lee patents disclose embodiments having adjustable handles attached to the catching implement to securely hold the player's hand in place. Both prior art patents also disclose the use of a hook and loop fastening material such as Velcro® to attach the ball to the catching implement.

One drawback of the prior art devices is the difficulty and/or inconvenience in removing the Velcro® material from the catching implement in the event that it becomes dirty, for example, by a muddy ball. Another drawback of the prior art devices is their lack of versatility; they offer no game alternatives if the players want variety. Specifically, neither the Bai patent nor the Lee patent discloses a catching implement which would itself be aerodynamically suitable for throwing to provide a variety of game alternatives from a single toy.

Accordingly, it would be desirable to provide implements for use in the game of catch that provide a greater variety of game options and are easier to clean than the prior art devices.

SUMMARY OF THE INVENTION

The present invention constitutes a multi-purpose toy for use in the game of catch. The toy includes a substantially planar aerodynamic plate which acts as both a catching implement and, in the alternative, a throwing implement. The plate is of the general type sold under the "FRISBEE"® trademark. In its first mode, a removable cover fabricated from flexible material is fitted over the plate. The plate cover further includes an adjustable handle and has a form of a separable hook and loop fastener, of the type sold under the trademark "VELCRO"® attached to at least a portion of the exterior surface of the plate cover extending across the front face or catching surface of the plate. A ball encased in the complementary hook and loop fastener may then be caught by the corresponding surface on the plate cover.

Because the plate cover is not permanently attached to the catching implement, it may be easily removed for cleaning. Also, the ability to easily remove the cover allows for substitute covers to be fitted over the plate. In this manner, a wide variety of different catching games may be played depending on the nature and/or design of the cover. Also, because the handle element is attached to the cover and not the catching implement, when the plate cover is removed, in its second mode, the plate itself may be tossed back and forth amongst the players due to its aerodynamic design, thus providing the multi-purpose toy with even more versatility.

BRIEF DESCRIPTION OF THE DRAWINGS

The following detailed description may best be understood by reference to the following drawings in which:

FIG. 4 is a perspective view of two players using an embodiment of the plate of the present invention in its catching mode; and FIG. 5 is a perspective view of two players using an embodiment of the plate of the present invention in its throwing mode.

DETAILED DESCRIPTION OF THE DRAWINGS

Figure 1:
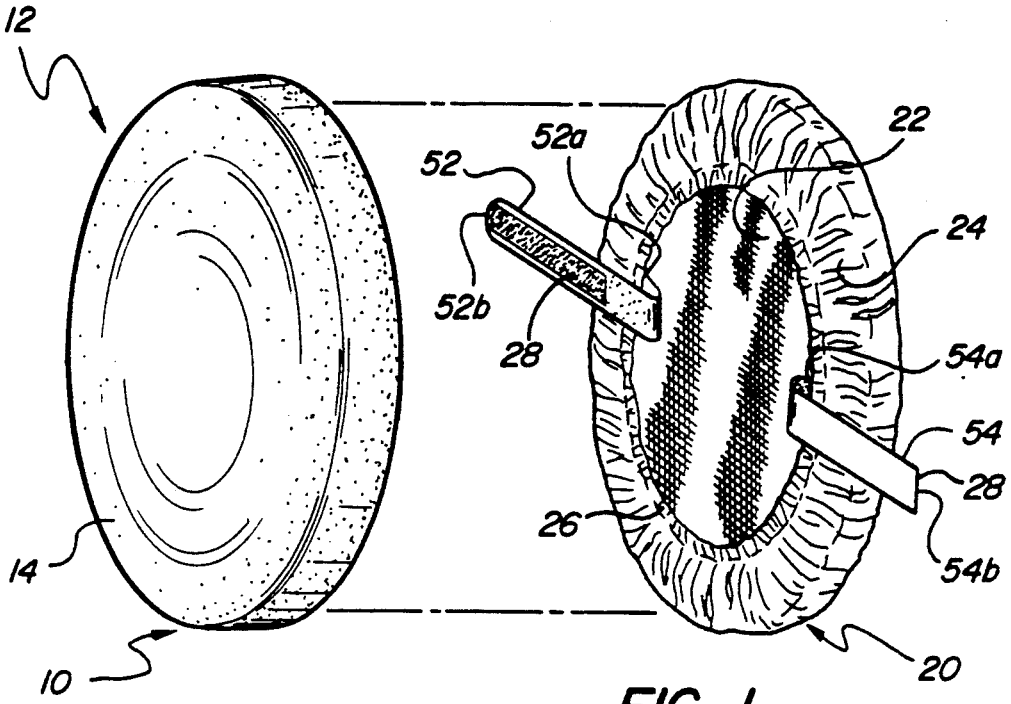
FIG. 1 is a perspective view of one embodiment of a multi-purpose toy structured in accord with the principles of the present invention, showing a plate cover in position to be fitted upon a plate.

Referring now to the drawings, and in particular to FIG. 1, there is shown a perspective view of one embodiment of a multi-purpose toy 10 comprising generally a plate 12 and a plate cover 20. As shown in FIG. 1, the plate cover 20 is in position to be fitted upon the plate 12. The plate 12 has a front face 14 and a back face 16 and is substantially planar, although in some embodiments, the front face 14 may be slightly concave. The plate 12 is aerodynamic, lightweight, and preferably resilient. In one preferred embodiment, the plate is fabricated from a lightweight, foamed, resilient polymer. Although in the preferred embodiment the plate 12 is a disc-shaped, Frisbee®-like plate, other aerodynamic shapes may also be used.

The removable cover plate 20 has an interior surface 22, an exterior surface 24, and an at least partially elasticized perimeter 26. As used within the context of this disclosure "elasticized" shall refer to any perimeter which is expandable and which includes biasing means for contracting the perimeter. The elasticized perimeter may include a separate resilient body such as an elastomeric body or a spring or it may include integral means such as crimps, pleats or the like for elasticizing the perimeter provided the material of the perimeter is resilient. The plate cover 20 is preferably fabricated from a flexible material so that the elasticized perimeter 26 may be readily attached to the cover material and stretched to facilitate the fitting of the plate cover 20 over the plate 12. Thus, it can be seen that the plate over 20 is capable of covering at least the front face 14 of the plate 12; preferably, a portion of the back face 16 is also covered.

The plate cover 20 further includes a handle 50. In the preferred embodiment, the handle 50 is adjustable and includes a first strap 52 and a second strap 54, each of said straps 52,54 having a first end **52*a*,54*a* and a second end 52*b*,54*b*. The first end 52*a* of the first strap 52 is attached to a portion of the elasticized perimeter 26 of the plate cover 20; likewise, the first end 54*a* of the second strap 54 is attached to an opposite portion of the perimeter 26 of the plate cover 20. The second ends 52*b*,54*b* are attachable to one another. Accordingly, the second straps 52,54 are of sufficient length that when the plate cover 20 is positioned upon the plate 12, the straps 52,54 extend across the back face 16 of the plate 12, overlap and attach together. In an alternative embodiment, the handle 50 may be a single strip of elastic having both ends attached to opposing portions of the plate cover perimeter 26. In yet another alternative, the handle 50 may comprise two loops attached to opposite sides of the elasticized perimeter 26** and oriented so that the first loop retains the player's wrist and the second loop retains the player's fingers.

Figure 2:
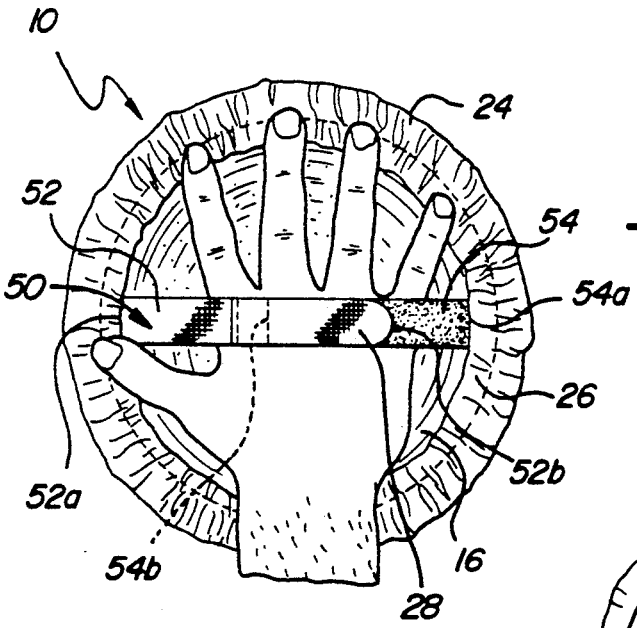
FIG. 2 is a back plan view of the present invention showing the plate cover fitted on the plate with a player's hand inserted between the handle and the plate.

FIG. 2 shows a back view of the preferred embodiment of the multi-purpose toy 10 wherein the plate cover 20 is positioned upon the plate 12, and the second ends **52*b*,54*b* of the handle 50 are attached together. The insertion of a player's hand between the handle 50 and the back face 16 of the plate 12 is also shown. In the preferred embodiment, a separable hook and loop fastener 28 of the type commonly sold under the trademark Velcro® is implemented to attach the second ends 52*b*,54*b* together. A body of hook material 30 is attached to the first strap 52, and a body of corresponding loop material 32 is attached to the second strap 54. Accordingly, the handle 50 may be easily adjusted to fit the size of the player's hand and to securely hold the multi-purpose toy 10 in place during play. Buckles, snaps, or other similar fastening means may be used to attach the second ends 52*b*,54*b*** together.

Figure 3:
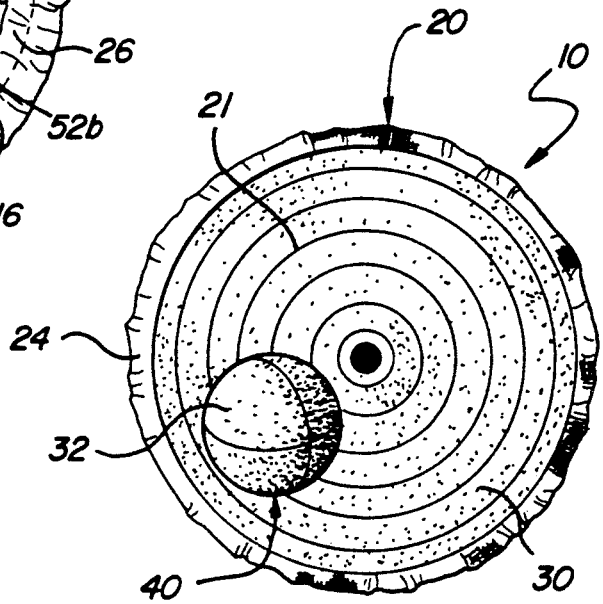
FIG. 3 is a front plan view of an embodiment of the present invention showing the interaction between the ball and the plate cover.

FIG. 3 shows a front view of an embodiment of the present invention wherein the plate cover 20 is positioned upon the plate 12. Separable hook and loop fastener material is implemented to attach the ball 40 to the exterior surface 24 of the plate cover 20. In a typical embodiment shown in FIG. 3, a body of hook material 30 is attached to the exterior surface 24 of plate cover 20; a corresponding body of loop material 32 is attached to the ball 40. Thus, the hook material 30 and the loop material 32 interact to enable the ball 40 to attach to the exterior surface 24 of the plate cover 20 upon contact. In an alternative embodiment, the hook material 30 attached to the exterior surface 24 may be a shape different than the plate perimeter so that substitution of the plate covers 20 would provide the players with a variety of different games. For this same reason, the exterior surface 24 of the plate cover 20 may further have target designs or other game indicia incorporated in the portion of the hook and loop fastener 28 attached to the plate cover 20.

FIG. 4 illustrates two players playing the game of catch using the plate 12 in its catching mode. The plate cover 20 is positioned over the plate 12, and the ball 40 is tossed amongst the players and caught on the exterior surface 24 of the plate cover 20 through implementation of the hook and loop fastener 28. Furthermore, the plate covers 20 preferably incorporate game indicia 21 to provide game variety. FIG. 5, on the other hand, illustrates the use of the plate 12 in its throwing mode. With the plate cover 20 removed, the plate 12 may be thrown in a Frisbee®-like fashion amongst the players.

It will be apparent to those skilled in the art that the multi-purpose toy of the present invention could be constructed in a variety of embodiments without departing from the spirit of the present invention. For example, the plate cover 20 may be constructed of cloth material or water-repellent plastic. The true scope of the present invention, therefore, is not limited to the exemplifications and embodiments illustrated herein, but solely by the claims.

Accordingly, I claim:

1. A multipurpose toy comprising:

a ball;

a substantially planar aerodynamic plate having a front face and a back face;

a removable plate cover fabricated from a flexible material and having an interior surface, an exterior surface, and an at least partially elasticized perimeter, said cover capable of covering at least the front face of said plate;

a separable hook and loop fastener comprising a section of hook material and a section of loop material, a first one of said sections being attached to a portion of the exterior surface of said plate cover, and the other of said sections being attached to the ball such that the hook and loop material sections interact to enable the ball to attach to the exterior surface of said plate cover upon contact therewith; and a handle attached to the perimeter of said plate cover;

whereby said multipurpose toy may be used with said plate cover positioned upon said plate to act as a catching implement to receive said ball in a throwing game, or in the alternative, said plate cover may be removed and said aerodynamic plate may be used as an object to be thrown.

2. The multipurpose toy of claim 1 wherein the aerodynamic plate is fabricated from a foamed resilient polymer.

3. The multipurpose toy of claim 1 wherein the plate cover includes game indicia on the front face thereof.

4. The multipurpose toy of claim 1 wherein the handle is adjustable and comprises a first strap and a second strap, each strap including a first end and a second end, the first end of said first strap being attached to a portion of the perimeter of said plate cover and the first end of said second strap being attached to an opposite portion of the perimeter of said plate cover, the second ends of said straps being attachable to one another, said straps being of sufficient length such that when said plate cover is positioned upon said plate, the straps of said handle overlap and attach together, extending across the back face of said plate.

5. The multipurpose toy of claim 4 wherein said handle further includes a separable hook and loop fastener comprising a body of hook material and a body of loop material, said hook material being attached to said first strap and said loop material being attached to said second strap.

6. The multipurpose toy of claim 1 wherein the handle comprises a single elastic strip, said strip having a first end attached to a portion of the cover plate perimeter and a second end attached to an opposed portion of the cover plate perimeter.

7. The multipurpose toy of claim 1 wherein the handle comprises a first loop and a second loop attached to opposite portions of the cover plate perimeter whereby the first loop retains the player's wrist and the second loop retains the player's fingers.

* * * * *